United States Patent [19]

Heck et al.

[11] Patent Number: 4,594,222

[45] Date of Patent: Jun. 10, 1986

[54] DISPERSION STRENGTHENED LOW DENSITY MA-AL

[75] Inventors: Frank W. Heck, Ramsey, N.J.; Stephen J. Donachie, New Windsor; Howard F. Merrick, Suffern, both of N.Y.

[73] Assignee: Inco Alloys International, Inc., Huntington, W. Va.

[21] Appl. No.: 356,637

[22] Filed: Mar. 10, 1982

[51] Int. Cl.[4] ..... C22C 21/00

[52] U.S. Cl. ..... 420/529; 148/12.7 A; 148/415; 148/416; 148/417

[58] Field of Search ..... 148/438, 439, 440, 415, 148/416, 417, 12.7 A; 420/529, 533

[56] References Cited

U.S. PATENT DOCUMENTS 3,740,210 6/1973 Bomford et al. ..... 75/0.5 AC

*Primary Examiner*—R. Dean

*Attorney, Agent, or Firm*—Miriam W. Leff; Raymond J. Kenny

[57] ABSTRACT

A dispersion strengthened aluminum-base alloy system is provided which is prepared by mechanical alloying and is characterized by an improved continuation of properties over binary aluminum-lithium alloys. The alloy system contains, by weight, about 0.5% up to about 4% Li, about 0.05 up to about 2% carbon, about 0.1 up to about 3% oxygen, at least one of the elements magnesium or copper in an amount of up to about 5% each, provided the total amount of said magnesium and copper does not exceed about 8%, and a dispersion strengthening agent in the amount of about 2% up to about 8% by volume.

22 Claims, No Drawings

DISPERSION STRENGTHENED LOW DENSITY MA-AL

The present invention relates to dispersion-strengthened aluminum, and more particularly, to mechanically alloyed aluminum-lithium alloy powders and consolidated products made therefrom.

BACKGROUND OF THE INVENTION

Considerable research efforts have been made to develop high strength aluminum which would satisfy the demands of advanced design in aircraft, automotive and electrical industries. Aluminum-lithium alloys are amongst those under consideration because of the potential that the addition of lithium to aluminum offers for improving properties of aluminum with respect to density and elastic modulus. However, the improvement of one or even two properties does not mean the alloy will be useful for certain advanced design applications. Rather, for the alloy to be useful, it must meet all the minimum target property requirements. Such properties as density, strength, ductility, toughness, fatigue and corrosion resistance, are among the properties considered.

Heretofore, many aluminum-lithium alloy systems prepared by ingot metallurgy techniques have been studied. Also, various aluminum-lithium, aluminum magnesium and aluminum-copper-magnesium systems, which have been prepared by mechanical alloying techniques, have been studied. However, none have been entirely satisfactory for certain applications which require low density, high strength, corrosion resistance, and good ductility.

The mechanical alloying technique has been disclosed, for example, in U.S. Pat. Nos. 3,591,362; 3,740,210; and 3,816,080. Mechanical alloying, as described in the aforesaid patents, is a method for producing compound metal powders with a controlled uniform fine microstructure. It occurs by the fracturing and rewelding of a mixture of powder particles during high energy impact milling in a controlled environment, e.g. in an attritor grinding mill, in the presence of a process control agent. In the process dispersoid materials such as, for example, the naturally occurring oxide on the surface of powder particles are incorporated into the interior of the composite powder particles and homogeneously dispersed therethrough. In a similar fashion metallic alloy ingredients are also finely distributed within the powder particles. The powders produced by mechanical alloying are subsequently consolidated into bulk forms by various methods such as hot compaction followed by extrusion, rolling or forging.

A major problem with many conventional aluminum-lithium alloys, e.g. binary alloys, is that when they meet requirements of density and strength, they are not sufficiently ductile to be useful. In accordance with the present invention, alloys are provided which have ductility as well as a combination of low density and high strength.

BRIEF DESCRIPTION OF INVENTION

In accordance with the present invention, a dispersion-strengthened mechanically alloyed aluminum-base alloy system is provided which is characterized by high strength, low density, and good ductility, said alloy system is comprised essentially of, by weight, about 0.5% to about 4% lithium, a small but effective amount for increased strength up to about 2% carbon, a small but effective amount for increased strength up to about 3% oxygen, at least one of the elements magnesium and copper in an amount of up to about 5% respectively, provided that the total magnesium and copper content does not exceed about 8% and provided that when the lithium content is above 1.5% up to about 3% and the alloy is copper-free the magnesium level is greater than 1%, and the balance essentially aluminum, said alloy containing, by volume, about 2% up to about 8% dispersoid. Mechanically alloyed powders in this system can be consolidated to materials having a combination of room temperature 0.2% yield strength of over about 345 MPa and an elongation of at least 3%.

The essential components of the dispersion-strengthened aluminum-base alloy of the present invention are aluminum, lithium, carbon, oxygen and at least one of the elements magnesium and copper. Other elements may be incorporated in the alloy so long as they do not interfere with the desired properties of the alloy for the particular end use, or may be picked up as impurities in preparing the alloy. Similarly, additional insoluble, stable dispersoid agents may be incorporated in the system, e.g., for strengthening of the system at elevated temperatures, so long as they do not otherwise adversely affect the alloy.

In the discussion below w/o refers to weight % and v/o refers to volume %. In the alloy system the component levels are interdependent.

The lithium is present in an amount of about 0.5 up to about 4 w/o, advantageously in an amount of about 1 up to about 3 w/o, and typically from about 1 up to about 2.5. In general, in alloys in which the copper or magnesium level is about 4% or greater, or the copper plus magnesium level is 5% or greater, then the lithium level does not exceed 2%.

The copper and magnesium levels may range from 0 up to 5 w/o, provided one of these elements is present. In the absence of copper, the alloys typically contain about 1.5 up to about 4.5 w/o magnesium, and in the absence of magnesium the alloys typically contain about 1.5 up to about 4.5 w/o copper. When both copper and magnesium are present the copper and magnesium levels are about 1 up to about 4.5 w/o respectively, provided the total amount of copper and magnesium does not exceed about 8 w/o, and preferably the total does not exceed about 5 w/o. In the event the lithium level is greater than about 1.5 w/o up to about 3% and copper is not present, the alloys contain above about 1 w/o magnesium. Exemplary alloys may contain, by weight, about 1 w/o up to about 3 w/o Li, at least one of the elements selected from copper and magnesium in the amount of about 1 w/o up to about 4 w/o and the balance essentially aluminum.

Oxygen is present in a small but effective amount for increased strength up to about 3 w/o, preferably about 0.5 up to about 1.25 w/o. Carbon is present in a small but effective amount for strength, e.g. about 0.05, up to about 2 w/o, typically 0.5 to 1.5, preferably about 0.7 up to about 1.3 w/o.

The oxygen and carbon are, in general, present in the alloy as part of the dispersoid system, e.g., as oxides or carbides. In general, the alloy system includes about 2 up to about 8 v/o (by volume) of finely divided, uniformly distributed dispersoid materials. Preferably the dispersoid level is about 3 up to about 7 v/o, and more preferably about 4 up to about 6 or 7 v/o. In general the dispersoid level is as low as possible consistent with the desired strength and the temperature at which the consolidated product will ultimately be used.

Typically, the dispersoid materials are oxides and carbides. For example, the dispersoid particles can be formed during the mechanical alloying process and/or a later consolidation and thermomechanical processing step. The process control agent used in the mechanical alloying process will usually contribute to the dispersoid content of the alloy. Examples of dispersoids that may be formed from aluminum and lithium components of the alloy are $Al_2O_3$, AlOOH, $Li_2O$, $Li_2AlO_4$, $LiAlO_2$, $LiAl_5O_8$, $Li_5AlO_4$, $Li_2O_2$ and $Al_4C_3$. Depending on components of the system, processing conditions and specific additives to obtain specific dispersoid, the dispersoid particle composition will vary. For example, if magnesium is present in the alloy, the dispersoid species may include magnesium containing dispersoids, e.g. MgO. Intermetallic particles may also be present.

Exemplary composition ranges are given in the Table I below, in which the carbon and oxygen components are in the range of about 0.5–1.5 w/o carbon and about 0.5–1.25 w/o oxygen, the dispersoid level in each of the alloys is about 4–7 v/o, and the total copper plus magnesium level in each of the alloys does not exceed 8 w/o.

TABLE I

| Weight % | | | |
|---|---|---|---|
| Li | Cu | Mg | Al |
| 2.0–2.5 | — | 2.0–2.5 | Bal. |
| 2.0–2.5 | 1.5–2.0 | 0–1.5 | Bal. |
| 1.0–1.5 | 3.0–4.5 | 1.0–1.5 | Bal. |
| 1.0–2.5 | 0–1.5 | 1.0–1.5 | Bal. |
| 1.0–2.5 | 1.5–4.5 | — | Bal. |
| 1.0–2.5 | 1.5–2.0 | — | Bal. |
| 1.0–1.5 | — | 2.0–4.0 | Bal. |
| 1.5–2.0 | 2.0–3.0 | 1.0–1.5 | Bal. |
| 1.0–3.0 | 1.5–4.5 | 1.5–4.5 | Bal. |
| 1.0–3.0 | 1.0–2.0 | 3.5–4.5 | Bal. |
| 1.0–3.0 | 3.5–4.5 | 1.0–2.0 | Bal. |

Alloys within the above composition ranges can be prepared which have in the consolidated form: room temperature tensile strength (UTS) of over about 414 MPa (60 ksi) and even over 586 MPa (85 ksi), e.g. 623 MPa (90.5 ksi), and higher; a room temperature 0.2% yield strength (YS) of at least 345 MPa (50 ksi) and even over 551 MPa (80 ksi), e.g. 575 MPa (83.5 ksi); a specific modulus of at least $116\times10^6$ in, e.g. ($123\times10^6$ in), and elongation of at least 3% and higher, e.g. 6% or 7%.

In a preferred embodiment of the invention, the alloy has a notch tensile strength/yield strength ratio which is equal to or greater than 1.

The formation of the mechanically alloyed, dispersion-strengthened, aluminum-base alloy powder and consolidation thereof is given in detail in the aforementioned U.S. Pat. Nos. 3,740,210 and 3,816,000 and a further method of thermomechanically treating the powders to form consolidated products is described in U.S. Pat. No. 4,292,079. As indicated the mechanically alloyed powder is formed by high energy milling, e.g., in an attritor using a ball to powder weight ratio of about 15:1 to 60:1 in the presence of a process control agent. The process control agent serves as both a weld-controlling, agent and may also serve as a carbon-contributing and/or oxygen-contributing agent, and is used in an amount to satisfy such functions. Suitable process control agents are, for example, graphite or a volatizable oxygen-containing organic compound such as an organic acid, alcohol, aldehyde, ether or an alkane such as heptane. Preferred process control agents are methanol, stearic acid and graphite. The oxygen and/or carbon content of the alloys may also be derived in whole or in part from the processing atmosphere. Alternatively, the dispersoid content may be, e.g., in part, incorporated as an additive in the alloy, as indicated above.

Before consolidation, the powder is degassed. The powder is then hot consolidated to a substantially dense body and worked at an elevated temperature, e.g., at about 370° to about 455° C. (700°–850° F.). In accordance with a typical consolidation technique, the powder is canned and degassed at about 510° C. (950° F.), hot consolidated and then extruded at about 472° C. (800° F.).

The consolidated product may benefit from a solution treatment and/or an age hardening treatment. For example, the consolidated product may be solution treated at a temperature of, e.g., between about 454°–566° C. (850°–1050° F.). After cooling to room temperature, an age hardening treatment of about 8–24 hours at a temperature of between about 149°–232° C. (300°–450° F.) may be applied. In a preferred embodiment of the invention, the alloy is solution treated at 496° C. (925° F.), cooled to room temperature, and naturally aged at room temperature.

The alloys of the present invention have high strength in addition to low density and high elastic modulus. Preferably, the ductility is at least about 3%.

The invention is further described by, but not limited to, the illustrative examples which follow

EXAMPLE I

Samples of dispersion-strengthened mechanically alloyed aluminum containing lithium and at least one of the elements copper and magnesium are prepared by high energy milling a mixture of powders in elemental or master alloy form in a 4 gallon attritor for about 9 hours under a blanket of argon in the presence of stearic acid to provide alloys of the compositions listed in Table II.

TABLE II

| | w/o | | | | v/o | Heat |
|---|---|---|---|---|---|---|
| Sample | Li | Cu | Mg | Al | Dispersoid | Treatment |
| 1 | 2 | 1.5 | — | Bal. | 6–7 | (a)/(b) |
| 2 | 2.2 | — | 2.2 | Bal. | 6–7 | (b) |
| 3 | 1 | — | 4 | Bal. | 6–7 | None |
| 4 | 1.5 | — | 4 | Bal. | 6–7 | None |

(a) Solution treated at 496° C. (925° F.) cooled to room temperature and naturally aged at room temperature.
(b) Solution treated at 551° C. (1025° F.) cooled to room temperature and naturally aged at room temperature.

EXAMPLE II

The powders of the composition in Table II are canned and hot degassed at about 204°–510° C. (400°–950° F.), consolidated to full density and extruded at ratios between about 12/1 to 35/1 and at a temperature of 427° C. (800° F.). Various samples of the consolidated powder are solution treated and aged. Conditions of treatment are listed in Table II. Typical properties for compositions in Table II are given in Table III in which UTS means ultimate tensile strength, YS means yield strength, % El means % elongation, $\rho$ means density, $E/\rho$ means modulus/density ratio, and NTS/YS means the ratio of notch tensile strength to yield strength.

TABLE III

| Sample | .2% YS MPa | .2% YS (ksi) | UTS MPa | UTS (ksi) | EL (%) | RA (%) | E/ρ in × $10^6$ | NTS/YS |
|---|---|---|---|---|---|---|---|---|
| 1a | 575 | (83.5) | 623 | (90.5) | 3 | 14.5 | 123 | 1.1 |
| 1b | 472 | (68.5) | 521 | (75.5) | 6 | 9.5 | N.D. | 1.4 |
| 2 | 493 | (71.5) | 510 | (74.0) | 5 | 6.5 | 126 | 1.2 |
| 3 | 565 | (82) | 592 | (86) | 7 | 14 | — | N.D. |
| 4 | 634 | (92) | 689 | (100) | 4 | 12 | — | N.D. |

ND = No data

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. A dispersion strengthened, mechanically alloyed aluminum-base alloy consisting essentially, by weight, of from about 0.5 to about 4% lithium, a small but effective amount for increased strength up to about 3% oxygen, a small but effective amount for increased strength up to about 2% carbon, at least one of the elements selected from the group consisting of copper and magnesium in an amount up to about 5%, provided that when copper and magnesium are both present the total amount does not exceed about 8%, and provided that when the lithium content is above 1.5% up to about 3% and the alloy is free of copper, the magnesium level is greater than 1%, and the balance essentially aluminum, and said alloy containing about 2 up to about 8% by volume of a refractory dispersoid, said alloy being characterized in the substantially fully dense consolidated form by a combination of room temperature 0.2% yield strength of over about 345 MPa and an elongation of at least 3%.

2. A dispersion strengthened alloy according to claim 1, wherein the alloy is essentially copper free and the magnesium level is about 1.5 up to about 4.5.

3. A dispersion strengthened alloy according to claim 1, wherein the alloy is essentially magnesium free and the copper level is about 1.5 up to about 4.5%.

4. A dispersion strengthened alloy according to claim 1, wherein the total copper and magnesium content does not exceed 5%.

5. A dispersion strengthened alloy according to claim 1, wherein the lithium content is about 1% up to about 3% by weight.

6. A dispersion strengthened alloy according to claim 5, wherein the copper content is up to about 1.5% and the magnesium content is up to about 4%.

7. A dispersion strengthened alloy according to claim 1, wherein the dispersoid content is at least about 3 volume %.

8. A dispersion strengthened alloy according to claim 1, wherein the dispersoid content is about 4 to 7 volume %.

9. A dispersion strengthened alloy according to claim 1, wherein the lithium level does not exceed 2 weight % when at least one of the alloy components selected from the group consisting of copper and magnesium is at least about 4 weight % and when the copper plus magnesium level is at least 5 weight %.

10. A dispersion strengthened mechanically alloyed aluminum-base alloy consisting essentially, by weight, of about 2 to about 2.5% lithium, a small but effective amount for increased strength up to about 3% oxygen, a small but effective amount for increased strength up to about 2% carbon, at least one element selected from the group consisting of copper and magnesium, said copper being present in an amount of up to about 2.0% and said magnesium being selected from an amount up to about 2.5%, provided that when the alloy is copper-free the magnesium content is above 1%, and the balance essentially aluminum, said alloy containing about 3 to about 7 volume % dispersoid, said alloys being characterized in the consolidated, solution treated, aged condition by a room temperature 0.2% yield strength of at least 345 MPa and an elongation of at least 3%.

11. A dispersion strengthened mechanically alloyed aluminum-base alloy consisting essentially, by weight, of about 1 to about 1.5% lithium, a small but effective amount for increased strength up to about 3% oxygen, a small but effective amount for increased strength up to about 2% carbon, about 2 to about 4% magnesium, and the balance essentially aluminum, said alloy containing about 3 to about 7 volume % dispersoid, and said alloy being characterized in the consolidated state by a room temperature 0.2% yield strength of at least 345MPa and an elongation of at least 4%.

12. A method of producing a dispersion-strenghtened aluminum base alloy of improved mechanical properties comprising: providing a mechanically alloyed aluminum-base alloy powder consisting essentially, by weight, of from about 0.5 to about 4% lithium, a small but effective amount for increased strength up to about 3% oxygen, a small but effective amount for increased strength up to about 2% carbon, at least one of the elements selected from the group copper and magnesium in an amount up to about 5%, provided that when copper and magnesium are both present the total amount does not exceed about 8%, and provided that when the lithium content is above 1.5% up to about 3% and the alloy is free of copper, the magnesium level is greater than 1%, and the balance essentially aluminum, and said alloy containing about 2 up to about 8% by volume of a refractory dispersoid, degassing and hot consolidating the powder to a substantially dense alloy, and solution treating the consolidated alloy; whereby an alloy is provided which is characterized in the consolidated solution treated condition by a combination of room temperature 0.2% yield strength of over about 345 MPa and an elongation of at least 3%.

13. A method according to claim 12, wherein the powder is hot degassed at a temperature of at least about 204° C.

14. A method according to claim 12, wherein the consolidated alloy is hot worked prior to the solution treatment and such hot working is carried out at temperatures in the range of about 370° C. to about 455° C.

15. A method according to claim 12, wherein the consolidated alloy is solution treated at a temperature of between about 454° C. to about 566° C.

16. A method according to claim 12, wherein the solution treated alloy is subjected to an aging treatment.

17. A method according to claim 16, wherein the aging is effected by natural aging.

18. A dispersion-strengthened mechanically alloyed aluminum-base alloy made by the process of claim 12.

19. A dispersion-strengthened alloy according to claim 1, wherein the lithium level is about 1 to about 2.2%, the magnesium level is 0 up to about 4%, and when the alloy is essentially magnesium-free, copper is present in the alloy in an amount of about 1.5% and wherein the alloy further characterized in the consolidated state by a NTS/YS ratio greater than 1.

20. A dispersion-strengthened alloy according to claim 1, wherein the alloy is essentially copper-free, lithium level is about 1.5 to about 2.2%, the magnesium level is about 2.2 to about 4, and wherein the alloy is further characterized in the consolidated state by a NTS/YS ratio greater than 1.

21. A dispersion strengthened mechanically alloyed aluminum-base alloy according to claim 1, wherein at least 1.5% lithium, by weight, is present in the alloy.

22. A dispersion strengthened mechanically alloyed aluminum-base alloy according to claim 21, wherein the alloy is copper free.

* * * * *